US007814770B2

(12) United States Patent
Jeon et al.

(10) Patent No.: US 7,814,770 B2
(45) Date of Patent: Oct. 19, 2010

(54) MULTI-FUNCTIONAL LAUNDRY DEVICE AND CONTROLLING METHOD FOR THE SAME

(75) Inventors: Si Moon Jeon, Seoul (KR); Tae Hee Lee, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 844 days.

(21) Appl. No.: 11/261,495

(22) Filed: Oct. 31, 2005

(65) Prior Publication Data

US 2006/0090524 A1 May 4, 2006

(30) Foreign Application Priority Data

Nov. 1, 2004 (KR) ..... 10-2004-0087946

(51) Int. Cl.
*D06F 29/00* (2006.01)

(52) U.S. Cl. ..... 68/13 R; 66/28; 66/30; 66/147; 66/200; 66/222

(58) Field of Classification Search ..... 134/13 R, 134/28, 30, 139, 147, 200, 222
See application file for complete search history.

(56) References Cited

U.S. PATENT DOCUMENTS 3,670,425 A * 6/1972 Benjamin et al. ..... 34/542
4,663,948 A * 5/1987 Rummel ..... 68/12.15
6,032,494 A * 3/2000 Tanigawa et al. ..... 68/12.06
2001/0020338 A1 * 9/2001 Arrieta et al. ..... 34/202
2004/0187529 A1 * 9/2004 Kim et al. ..... 68/207
2004/0194339 A1 * 10/2004 Johnson et al. ..... 34/595

FOREIGN PATENT DOCUMENTS

| | | | |
|---|---|---|---|
| EP | 1029961 | * | 8/2000 |
| KR | 93-25679 | * | 12/1993 |
| KR | 93-25679 U | | 12/1993 |
| KR | 10-2003-0084066 | * | 2/2002 |
| KR | 2003-0084066 A | | 11/2003 |
| KR | 10-2004-0009401 A | | 1/2004 |

* cited by examiner

*Primary Examiner*—Michael Barr
*Assistant Examiner*—Jason Heckert
(74) *Attorney, Agent, or Firm*—Birch, Stewart, Kolasch & Birch, LLP

(57) ABSTRACT

A multi-functional laundry device and control method for same treats the laundry efficiently has a washing unit for washing the laundry and a drying unit integrated with the washing unit as one body for after-washing treatment including smoothing out wrinkles, and drying. A control unit provided at either of the washing unit and the drying unit for controlling the washing unit and the dry unit selectively provides steam to the washing and drying units.

14 Claims, 5 Drawing Sheets

MULTI-FUNCTIONAL LAUNDRY DEVICE AND CONTROLLING METHOD FOR THE SAME

This application claims the benefit of the Patent Korean Application No. P2004-87946, filed on Nov. 1, 2004, which is hereby incorporated by reference as if fully set forth herein.

BACKGROUND OF THE INVENTION

1. Field of the Invention

The present invention relates to a laundry device, and more particularly, to a multi-functional laundry device capable of treating the laundry efficiently and controlling method for the same.

2. Discussion of the Related Art

In general, laundry devices wash and dry textile articles such as items of clothing and bed linen (hereafter referred to as laundry) including washing machines and dryers.

The washing machines remove dirt of the laundry by using impact of water circulation and chemical action of detergent.

The dryers dry the laundry in a relatively fast time by supplying high temperature air to the washed damp laundry.

There are two types of drying method. The one is forcibly circulating hot air heated by the heater. The other is discharging air having passed through the drum, However, related art dryers have several problems. A first problem is that the laundry may get tangled, because drying is performed at one time after the laundry is introduced therein. Also, if the laundry is left in a state of being tangled for a long time, laundry damage may be caused.

A second problem is that a user has to do an additional process of putting weights on an end of the laundry in a state of being on a hanger as well as keeping the weights.

A third problem is that the user has to purchase a washing machine, because the conventional drying machines perform only drying and keeping the laundry, not washing.

The last problem is that there is a difficulty in defining an installment space, because the user has to purchase not only a drying machine but also a washing machine. Also, due to the duplication of some part of the configuration, the production cost may rise.

SUMMARY OF THE INVENTION

Accordingly, the present invention is directed to a multi-functional laundry device capable of treating the laundry efficiently, and a controlling method for the same that substantially obviates one or more problems due to limitations and disadvantages of the related art.

An object of the present invention is to provide a multi-functional laundry device capable of treating the laundry efficiently, and a controlling method for the same.

Another object of the present invention is to provide a multi-functional laundry device having multi-functions as well as reducing a cost for treating the laundry and a controlling method for the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the present invention comprises a washing unit for washing the laundry; a drying unit integrated with washing unit for after-washing treatment including smoothing out wrinkles, and drying and keeping the laundry at; a control unit provided at either of the washing unit and the drying unit for controlling operation of both the washing unit and the drying unit.

A steam supplier may be further included for supplying steam to the laundry.

The steam supplier provided within the drying unit may include an inlet pipe for receiving water from outside, a water tank for storing the water drawn through the inlet pipe, a heater for heating the water and phase-changing the water into steam, and an outlet pipe for guiding the steam from the water tank to the laundry.

The steam supplier is provided in either of the washing unit and the drying unit, and the steam generated in the steam supplier is supplied to at least one of a drum of the washing unit and a drying chamber of the drying unit.

Also, the steam supplier may include an inlet pipe for receiving water from outside, a water tank for storing the water drawn through the inlet pipe, a heater for heating the water and phase-changing the water into steam, a first and a second outlet pipe for guiding the steam to the laundry, and a control valve for controlling the flow of the steam moving through the first and second outlet pipe.

Preferably, the first outlet pipe is connected to an inside of the drum, and the second outlet pipe is connected to an inside of the dry chamber.

In case only the washing unit is in operation, the first outlet pipe is opened and the second outlet pipe is closed to supply steam into the drum.

According to the multi-functional laundry device, a hot air supplier is further included for supplying hot air to the laundry to dry the laundry.

The hot air supplier provided within the drying unit may include a fan for circulating air forcibly and a heater for heating the air flown by the fan.

Furthermore, the hot air supplier may include a circulation duct including an drying chamber inlet in communication with a first side of the drying chamber of the drying unit and a drying chamber outlet in communication with a second side of the drying chamber of the drying unit, and a condensing part provided within the circulation duct for removing moisture from the air trough the drying chamber.

The condensing part may include a condensed water supply pipe for supplying water into the circulation duct.

Also, the condensing part provided at the circulation duct may include a heat exchanger in which the air discharged from the drying chamber is flown toward a first side thereof and outside air is flown toward a second side thereof, a cooling fan provided at a first side of the heat exchanger for drawing the outside air forcibly to send it to the heat exchanger, an exhaust duct for discharging the outside air having passed through the condense heat exchanger to an outside, and a condensed water outlet pipe for discharging the condensed water generated from the condense heat exchanger to an outside.

Still further, the hot air supplier comprises a guide duct including a drying chamber inlet in communication with a first side of the drying chamber in the drying unit and an outside air inlet hole in communication with an outside.

Preferably, the hot air supplier selectively supplies the hot air into the drum of the washing unit and the drying chamber of the drying unit.

The hot air supplier may include a fan for circulating air forcibly, a heater for heating the air flown by the fan, a hot air guide duct for guiding the flow of the air heated by the heater, and an air passage control valve for controlling the flow of the air moving through the hot air guide duct.

The hot air guide duct may include a first circulation duct provided within the washing unit, a second circulation duct for guiding the air heated to dry the laundry in the drying unit, and a third circulation duct for connecting the drying chamber to the first circulation duct.

The air passage control valve may include a first air passage control valve for opening/closing the first and second circulation duct, and a second air passage control valve for opening/closing the third circulation duct.

Preferably, the heater and the fan are provided within the first circulation duct.

Also, preferably in case of the rough drying in the washing unit the first circulation duct is opened and the second circulation duct and the third circulation duct are closed.

At least one hanger is provided within the drying chamber of the drying unit for keeping the laundry.

A perfume diffuser for diffusing perfume to the laundry may be further included.

In another aspect of the present invention, a multi-functional laundry device according to a second embodiment of the present invention includes a washing unit for washing the laundry; a drying unit integrated with the washing unit as one; a hot air supplier provided in either of the washing unit and the drying unit for supplying hot air to the laundry; a steam supplier provided in either of the washing unit and the drying unit for supplying steam to the laundry; and a control unit mounted at either of the washing unit and the drying unit for controlling the washing unit and the drying unit.

In another aspect of the present invention, a control method of a multi-functional laundry device according to a third embodiment of the present invention may include steps of washing the laundry after being introduced into a drum provided in a washing unit; drying the laundry in the drying unit integrated with the washing unit as one body; supplying steam to the laundry directly.

A step of roughly drying the laundry within the washing unit may be further included.

The step of supplying steam may further include a step of selectively guiding the generated steam to the drum of the washing unit and the drying chamber of the drying unit.

The step of drying the laundry may further include steps of operating the fan for allowing air to flow within the drying unit; driving the heater for heating the flowing air, and supplying hot air to the laundry.

Also, the step of drying the laundry may further include a step of removing the moisture from the air discharged from the dry chamber.

Preferably, in the step of the supplying the hot air, the hot air is selectively guided into the drum of the washing unit and the drying chamber of the drying unit.

A step of diffusing perfume to the laundry within the drying chamber of the drying unit may be further included.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
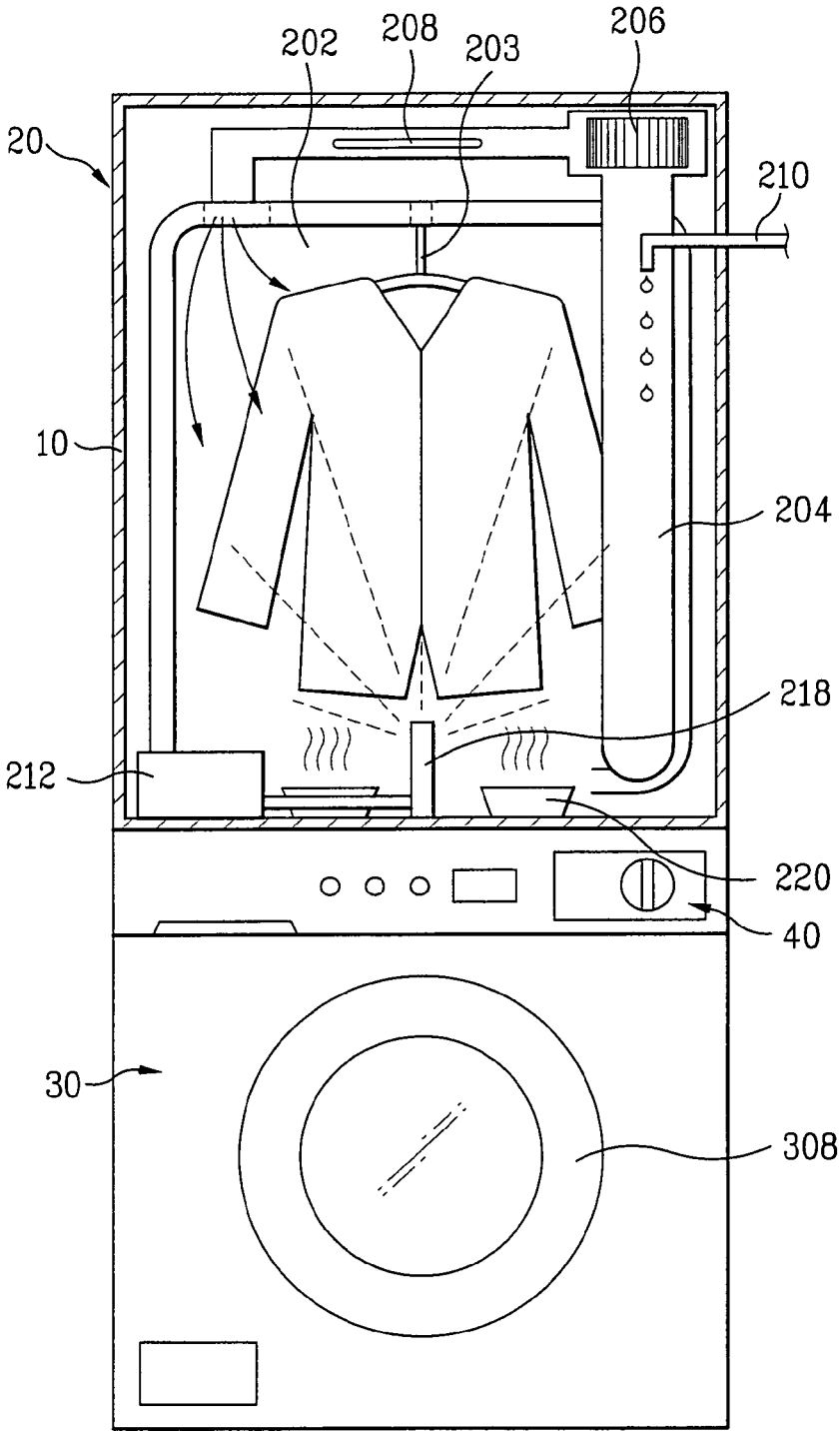
FIG. 1 is a sectional front view of a configuration of a first embodiment of a multi-functional laundry device according to the present invention.
Figure 2:
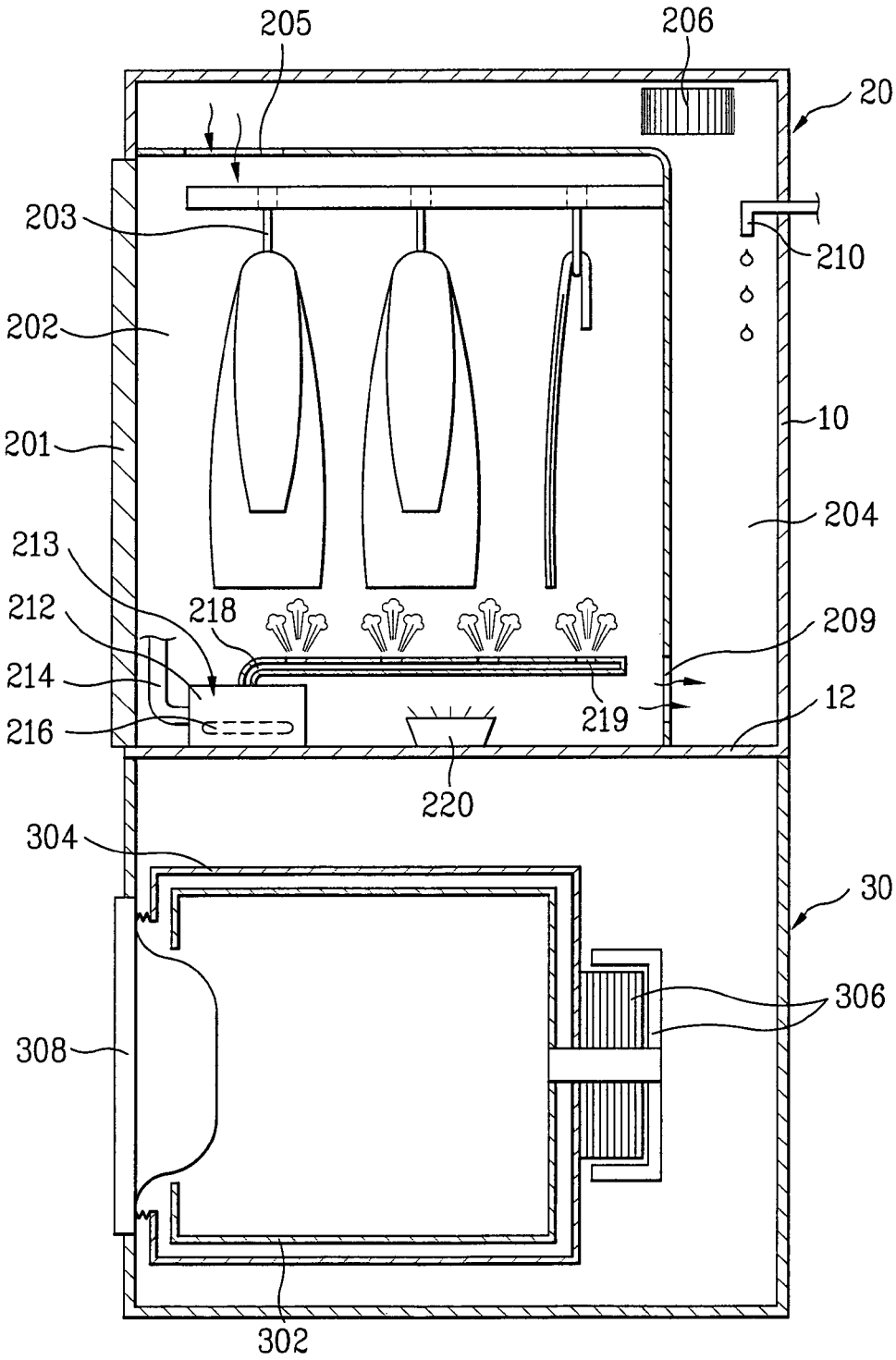
FIG. 2 is a sectional side view of key-parts of the multi-functional laundry device of FIG. 1.

Referring to FIGS. 1 and 2, the first embodiment of the multi-functional laundry device according to the present invention will be described.

The laundry device includes a washing unit 30 for performing washing, a drying unit 20 for performing an after-washing treatment.

The after-washing treatment means a process of managing the laundry after washing, such as drying, smoothing out wrinkles and keeping the laundry.

The drying unit 20 is integrated with the washing unit 30 as one body for the user's convenience. The drying unit 20 is mounted on a top of the washing unit 30, and the washing unit 30 and the drying unit 20 are divided by a partition wall 12 into an upper portion and a lower portion. Alternately, the drying unit 20 may be mounted on a side or a lower portion of the washing unit 30.

A control unit 40 is provided in the washing unit 30 for controlling operation of the washing unit 30 and the dry unit 20. Alternately, the control unit 40 may be mounted independently from the drying unit 20 and the washing unit 30.

The washing unit 30 includes a drum 302 for holding the laundry, a tub 304 for receiving washing water, a drive motor 306 for rotating the drum 302, and a door 308 for opening/closing the drum 302.

The drum 302 has a cylindrical shape, and rotates in a washing and a drying cycle. The tub 304 is provided outside of the drum for holding the washing water. Also, the door 308 is provided in front of the drum 302 for introducing or taking out the laundry.

The drying unit 20 includes a drying chamber 202 to supply space for the after-washing treatment of the laundry, a hot air supplier for supplying hot air to the laundry, and a steam supplier 213 for supplying steam to the laundry.

At least one hanger 203 is provided within the drying chamber 202 for keeping the laundry. Also, a drying unit door 201 is mounted in front of the drying chamber 202 for opening/closing the drying chamber 202.

The steam supplier 213 includes an inlet pipe 214 for receiving water from outside, a water tank 212 for storing the water drawn through the inlet pipe 214, a heater 216 for heating the water in the water tank, and an outlet pipe 218 for discharging steam generated in the water tank.

The steam supplier 213 is provided with the drying unit 20 for supplying steam into the drying chamber of course, the steam supplier 213 may be provided in either of the washing unit 30 and the drying unit 20. Also, the steam generated from the steam supplier may be supplied to either of the drum 302 and the drying chamber 202.

A first side of the inlet pipe is connected to a water pipe (not shown), and a second side thereof is connected to a water tank 212 allowing the drawn water temporarily stored.

The heater 216 is provided within the water tank 212 for heating and transition from the stored water into steam. The outlet pipe 218 is provided on a top of the water tank 212 for discharging the generated steam.

Furthermore, at least one steam outlet hole 219 is formed in the outlet pipe 218. Preferably, each of the steam outlet holes 219 may be formed at a predetermined distance.

The steam supplier may further include a steam tank both the steam tank storing the steam generated from the water tank and a steam tank valve for controlling the amount of air discharged from the water tank to the outlet pipe. Thus, the steam generated from the steam tank may be discharged at a regular time period by the control of the steam tank valve.

A process will be described that the steam is supplied into the drying chamber of the drying unit.

First, water is supplied from an outside through the inlet pipe 214. Then, the drawn water is stored in the water tank 212 temporarily. The stored water is heated by the heater 216 in the water tank to be phase-changed into steam. Hence, the steam moves to the outlet pipe 218 and is discharged into the drying chamber 202 through the steam outlet holes 219.

The hot air supplier includes a fan 206 for flowing the air forcibly, a heater 208 for heating the air flown by the fan, a circulation duct 204. The circulation duct 204 includes an inlet 205 in communication with a first side of the drying chamber and an outlet 209 connected to a second side of the drying chamber.

The fan 206 and the heater 208 are provided within the circulation duct for supplying hot air to the laundry. It is preferred but not necessary that the heater may be an electric heater.

Furthermore, a condensed water supply pipe 210 is provided within the circulation duct for removing moisture from the air discharged through the drying chamber 202. A first side of the condensed water supply pipe 210 is connected to an external water pipe (not shown), and a second thereof is connected to an inside of the circulation duct 204. Hence, when the water is drawn via the condensed water supply pipe 210, the water removes the moisture from the air discharged via dry chamber.

However, the present invention is not limited to the above described embodiments and a supplementary condenser may be provided.

For example, the condensing part may include a heat exchanger for condensing the moisture in the air from the drying chamber, a fan for forcibly circulating the outside air drawn into the condenser, and an outlet pipe for discharging the condensed water generated from the heat exchanger to an outside.

The cooling fan is provided at a first side of the condense heat exchanger for forcibly inhaling the outside air and ventilating it to the condense heat exchanger. Hence, the outside air flown into the inside of the condense heat exchanger may be heat-exchanged with the air discharged from the drying chamber.

Thereby, the moisture in the air discharged from the drying chamber may be removed by using the outside air.

Also, a perfume diffuser 220 is provided in a lower portion of the drying chamber. The perfume diffuser not only sterilizes the laundry but also allows fresh scent to penetrate the laundry. That is, the perfume diffuser is employed to refresh the laundry together with the steam supplier.

Operation of the laundry device with the above configuration will be described as follows.

First, the user introduces the laundry within the drum 302 of the washing unit, and then operates the washing unit 30 by using the control unit 40. Once washing is completed by the washing unit 30, the user opens the washing door 308 to take out the laundry from the drum 302.

Next, to dry the washed laundry the user opens the drying unit door 201 to hang the washed laundry on the hangers 203 within the drying chamber. After that, the user puts the drying unit 20 into operation by using the control unit 40.

Hence, the air is forcibly circulated by the fan 206 and heated by the heater 208. The heated air is drawn into the drying chamber 202 via the inlet 205 of the drying chamber. The air drawn into the drying chamber 202 dries the laundry, and is re-drawn into the circulation duct 204 via the outlet 209 of the drying chamber.

Next, the water supplied through the condense supply pipe 210 removes the moisture contained in the air. Hence, repeatedly, after allowing the moisture removed from itself, the air passes through the fan 206 and is heated by the heater 208 to be drawn into the drying chamber 202.

On the other hand, during the drying of the laundry or after the drying, the steam supplier 213 supplies steam to the laundry to smooth out wrinkles of the laundry. The process of supplying steam will be omitted, because it is the same as described before.

Furthermore, after the operation of the steam supplier 213 or at the moment that the steam supplier starts its operation, the perfume diffuser 220 is operated to supply fresh perfume. The steam and/or the perfume smooth out the wrinkles of the laundry as well as sterilize the laundry, thereby performing a refresh function.

Figure 3:
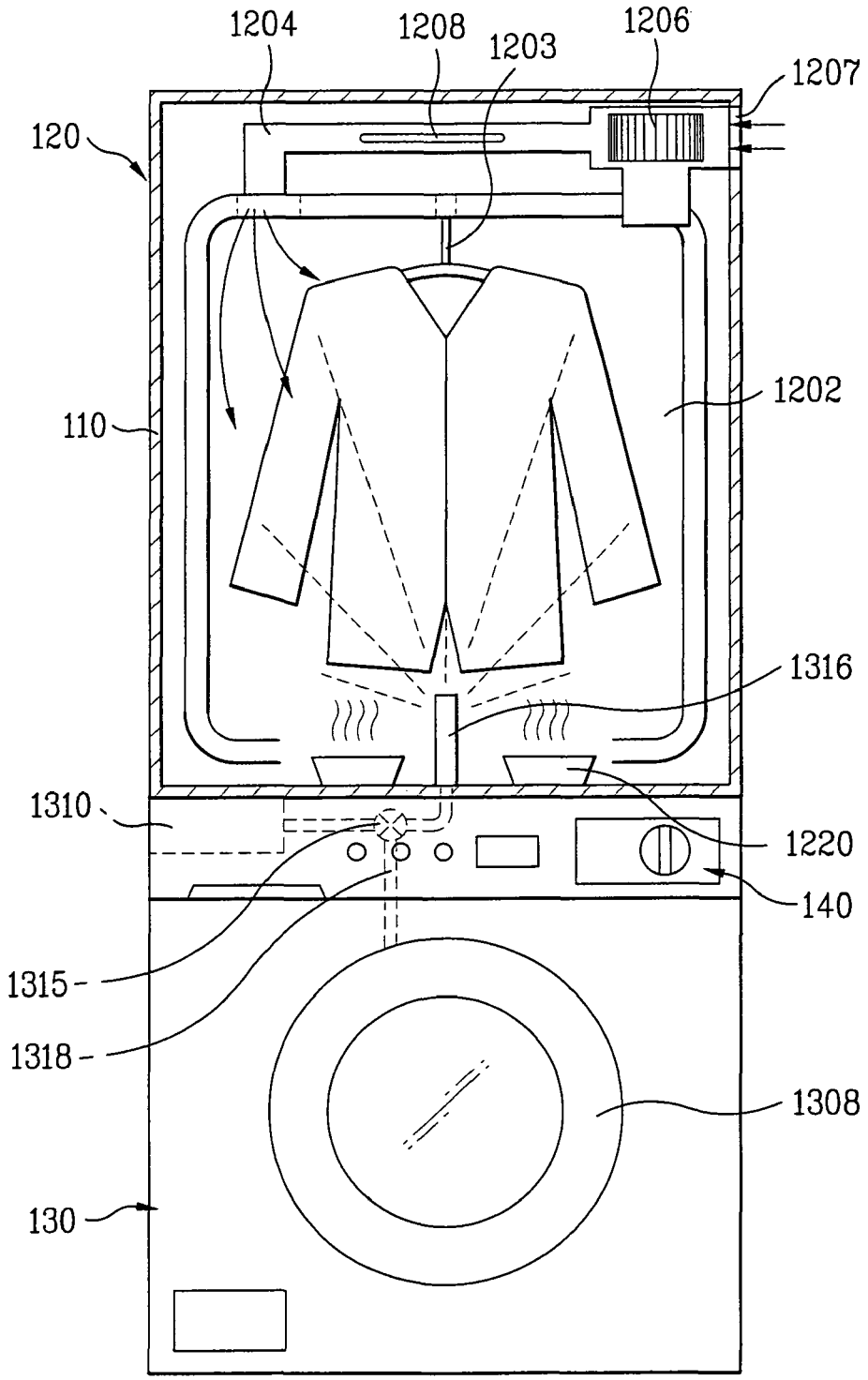
FIG. 3 is a sectional front view of a second embodiment of the multi-functional laundry device according to the present invention.
Figure 4:
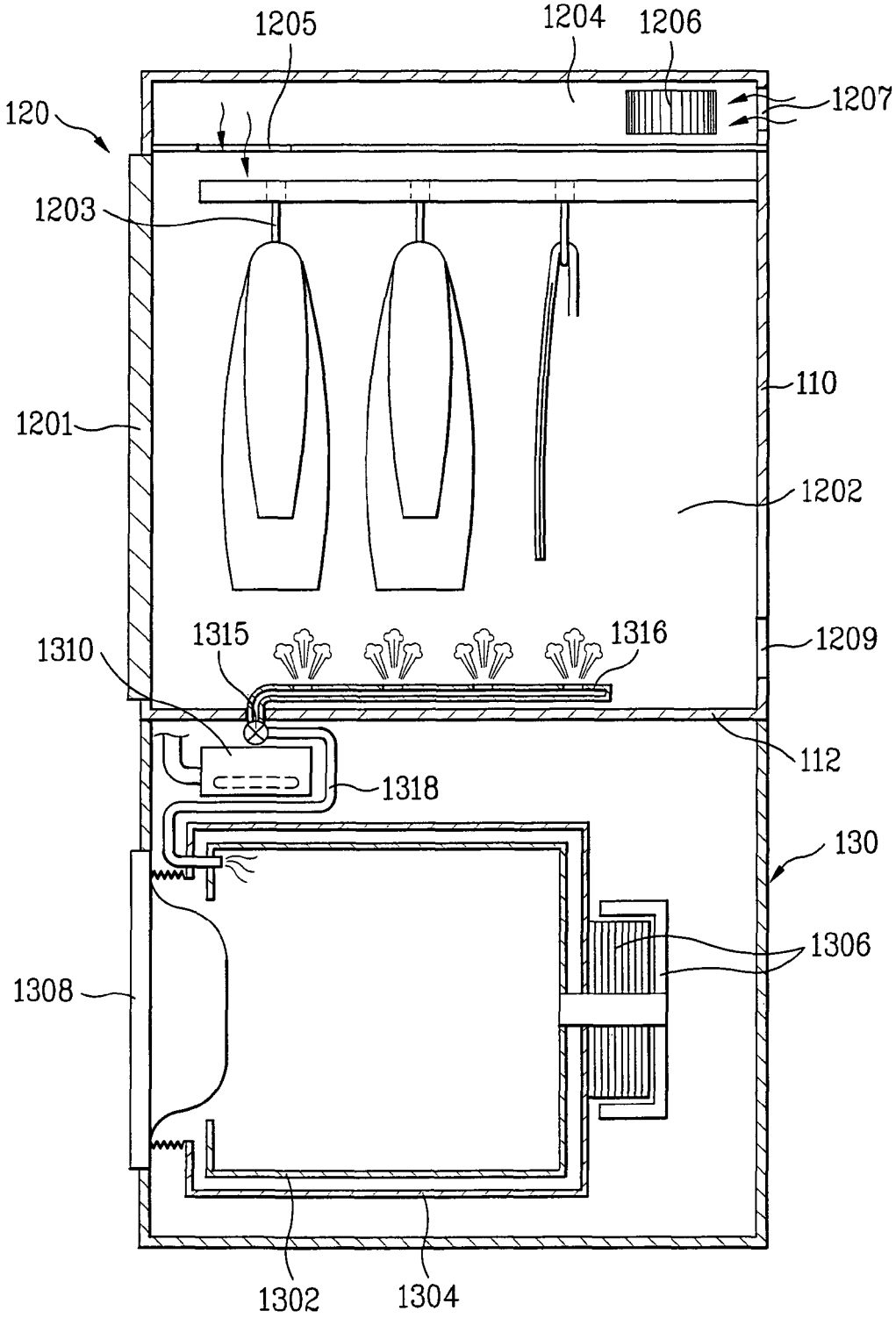
FIG. 4 is a sectional side view of key-parts of the multi-functional laundry device of FIG. 3.

Referring to FIGS. 3 and 4, the second embodiment of the laundry device according to the present invention will be described.

In the second embodiment of the laundry machine according to the present invention, unlike the first embodiment, the steam supplier 1310 is provided on an upper portion of the washing unit 130 inside. Also, the air having passed through the drying chamber 1202 is discharged outside, not circulated inside of the drying unit 120.

The steam supplier 1310, unlike the steam supplier described in the first embodiment, further includes an outlet pipe for guiding the steam generated in the water tank into the drying chamber 1202 and the drum 1302, and a control valve 1315 for controlling the steam flow.

The outlet pipe includes a first outlet pipe 1316 in communication with an inside of the drying chamber 1202, and a second outlet pipe 1318 in communication with a front of the drum 1302.

Also, an air passage control valve 1315 is provided at the portion in which the first and second outlet pipe 1316 and 1318 are branched out.

Therefore, the steam supplier may supply steam into the drum even during the washing cycle in the washing unit. That is, the steam generated from the steam supplier is supplied to at least one of the drum of the washing unit and the drying chamber of the drying unit.

The drying unit 120 includes a drying chamber 1202 for after-washing treatment of the laundry and a hot air supplier for supplying hot air to the laundry.

The hot air supplier includes a guide duct 1204 having a drying chamber inlet 1205 in communication with a first side of the drying chamber 1202 and an outer air inlet hole 1207 in communication with outer air, a fan 1206 for forcibly flowing the air, and a heater 1208 for heating the air.

The guide duct 1204 is provided on a top of the drying unit 120, and the fan 1206 and the heater 1208 are provided within the guide duct 1204. Also, an exhaust pipe 1209 is formed in a lower portion of the drying chamber for guiding the air inside the drying chamber to be discharged outside.

On the other hand, a plurality of hangers 1203 is provided within the drying chamber 1202 for having the laundry hung. A perfume diffuser 1220 is provided in a lower portion of the drying chamber for diffusing perfume. The detailed description on the above two configurations is the same with that of the first embodiment described before. Therefore, it will be omitted.

Operation process of the laundry device configured as presented before will be described.

First, the user introduces the laundry into the drum 1302 of the washing unit to be washed. If he/she would like to supply steam into the drum during the washing cycle, the user allows the steam supplier 1310 to get operated. At that time, the first outlet pipe 1316 is closed by the operation of the control valve 1315, and the second outlet pipe 1318 is opened.

Hence, the steam via the second outlet pipe 1318 is drawn into the drum to perform steam washing. The steam washing enhances washing efficiency and reduces power consumption used in washing.

Next, the user brings the washed laundry to the drying unit 120. Then, once the user puts the drying unit 120 into operation, the fan 1206 and the heater 1208 are operated. The fan 1206 draws outer air into the guide duct 1204 through the outer air inlet hole 1207. The drawn air is heated by the heater 1208 to be drawn into the drying chamber 1202 through the drying chamber inlet 1205.

Next, the air drawn into the dry chamber dries the laundry and the damp air is discharged outside via the exhaust pipe.

During the drying cycle in the drying chamber 1202 or after completing drying the laundry, steam is supplied into the drying chamber. In case that the steam is supplied only into the drying chamber 1202, the first outlet pipe 1316 is opened and the second outlet pipe 1318 is closed.

Meanwhile, when the drying unit performs drying and the washing unit performs washing at the same time, steam is supplied into both the drying chamber 1202 and the drum 1302. In that case, both the first and the second outlet pipe 1316 and 1318 are opened.

Also, at the moment of the operation of the steam supplier 1310, or independently from whether the steam supplier is operated or not the perfume diffuser 1220 is operated to supply perfume to the laundry.

Figure 5:
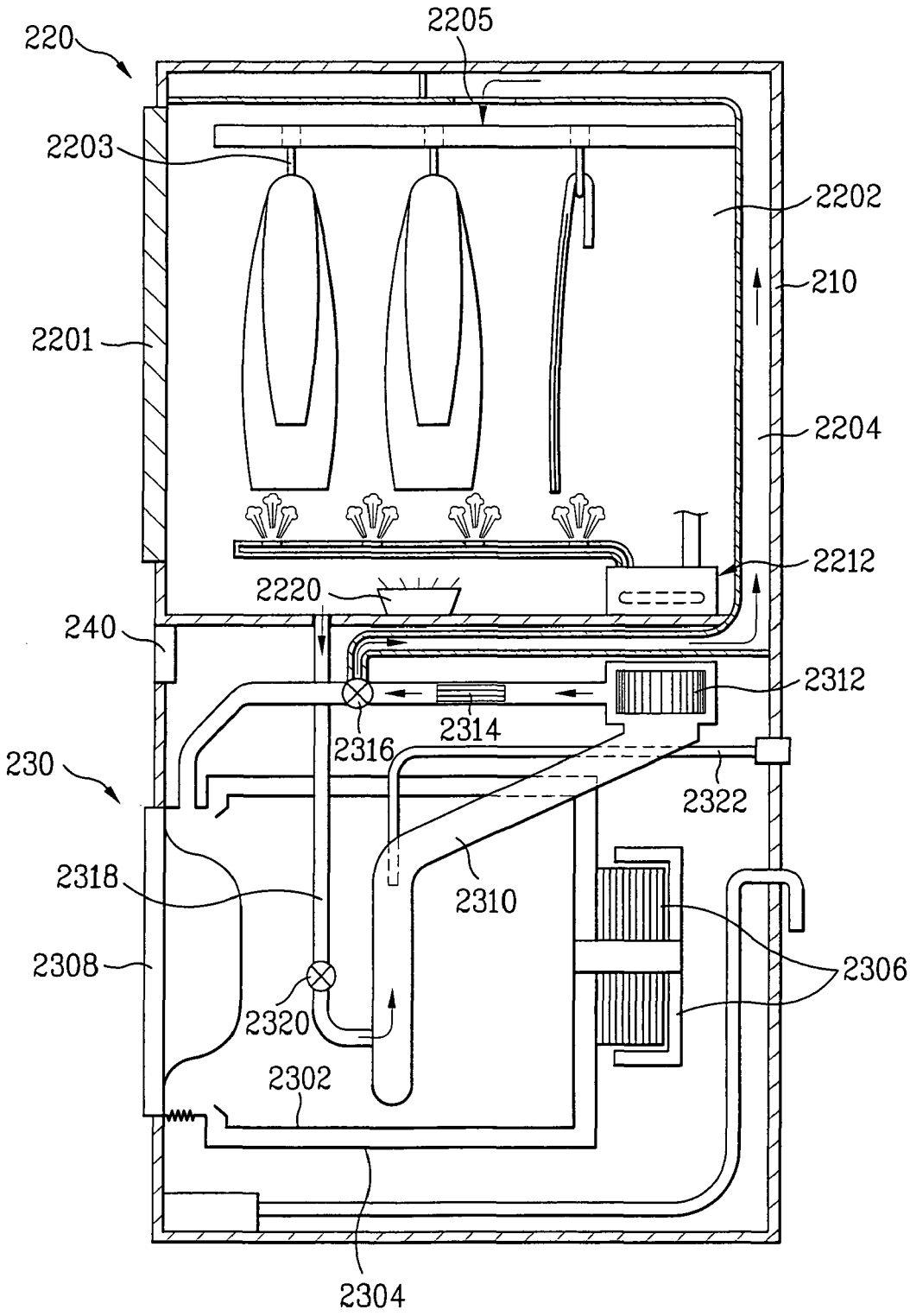
FIG. 5 is a sectional front view of a third embodiment of the multi-functional laundry device according to the present invention.

Referring to FIG. 5, the third embodiment of the laundry device according to the present invention will be described.

The laundry device includes a washing unit 230 for washing and drying the laundry, a drying unit 220 for after-wash treatment of the laundry having been washed, and a control unit 240 for controlling the washing unit 230 and the dry unit 220.

The washing unit 230 is a two-way washing unit for both washing and drying the laundry. It includes a drum 2302 provided within the washing unit, a tub 2304, a motor 2306, and a washing door 2308.

Furthermore, a hot air supplier is mounted in the washing unit 230 for supplying hot air to a drying chamber 2202 of the drying unit and the drum 2302 of the washing unit.

The hot air supplier includes a fan 2312 for flowing the air forcibly, a heater 2314 for heating the air flown by the fan, a hot air guide duct for guiding the flow of the air heated by the heater, and an air passage control valve for controlling the air flow through the hot air guide duct.

The hot air guide duct includes a first circulation duct 2310 provided within the washing unit, a second circulation duct 2204 for guiding the heated air to the drying chamber so as to dry the laundry in the drying unit, and a third circulation duct 2318 for connecting the drying chamber 2202 with the first circulation duct 2310.

The second circulation duct 2204 formed extending toward the inside of the drying unit 220 after passing through the washing unit 230. However, the second circulation duct may be provided outside of the washing unit and the drying unit to connect the washing unit with the drying unit.

The third circulation duct 2318 is extending toward the drum inside of the washing unit with passing through an outside wall of the drying duct to connect the drying chamber 2202 with the first circulation duct.

The fan 2312 and the heater 2314 are mounted within the first circulation duct to be operated during a rough drying cycle in the washing unit, or a drying cycle in the drying unit 220.

The air passage control valve includes a first air passage control valve 2316 for opening/closing the first and the second circulation duct 2310 and 2204, and a second air passage control valve 2320 for opening/closing the third circulation duct 2318.

The first air passage control valve 2316 is installed at the portion where the first and the second circulation duct 2310 and 2204 are branched out. The second air passage control valve 2320 is installed at any portion of the third circulation duct 2318.

In case of the rough drying cycle in the washing unit 230, the first circulation duct 2310 is opened and the second and third circulation duct 2204 and 2318 are closed.

Also, in case of the drying cycle in the drying unit, all the first, second and third circulation duct 2310, 2204 and 2318 are opened.

On the other hand, a condensed water supply pipe 2322 is installed within the washing unit for removing moisture from the air flowing in the first circulation duct 2310.

A steam supplier 2212 and a perfume diffuser 220 are provided within the drying unit. The detailed description on the above condensed water supply pipe, steam supplier and perfume diffuser is the same as that of the first embodiment, thereby being omitted.

Operation process of the configuration of the laundry device according to the third embodiment of the present invention will be described.

First, once the user puts the laundry into the drum of the washing unit to operate the washing unit 230, washing water is supplied into the drum 2302 to perform a washing cycle.

After completing the washing cycle, the fan 2312 and the heater 2314 are operated to start a rough drying cycle. Air is flown through the circulation duct 2310 by the fan 2312. After being heated by the heater 2314, the air is drawn into the drum 2302 to dry the laundry.

At that time, the second circulation duct 2204 is closed by the first air passage control valve 2316, and the third circulation duct 2318 is closed by the second air passage control valve 2320. On the other hand, the first circulation duct 2310 is opened by the first air passage control valve 2316. Thus, the air heated by the heater is circulated inside the first circulation duct.

The damp air after having dried the laundry is re-drawn into the first circulation duct 2310. The moisture contained in the air is removed by the water supplied through the condensed water supply pipe 2322.

After completing the rough drying cycle, the user opens the washing door 2308 to take out the laundry and bring it into the drying unit 220, and operates the drying unit 220.

Once the dry unit 220 is put into operation, the first, second and third circulation duct 2310, 2204 and 2318 are opened by the first and second air passage control valve 3216 and 2320.

Hence, the air flown by the fan 2312 is heated by the heater 2314. After that, the heated air is flown to the second circulation duct 2204 and drawn into the drying chamber 2202 to dry the laundry.

Next, the damp air having dried the laundry is discharged through the third circulation duct 2318 mounted in a lower portion of the drying chamber 2202, and then re-drawn into the first circulation duct 2310.

Next, the moisture contained in the air drawn into the first circulation duct is removed by the water supplied through the condensed water supply pipe 2310. The air relieved of the moisture is re-heated by the heater and is flown forcibly by the fan 2312.

Finally, like the laundry device of the embodiments described before, during the drying cycle in the drying unit 220 or after completing the drying cycle, steam is supplied to the laundry by the steam supplier 2212. Also, while the steam is being supplied or after completing the steam supply, the perfume diffuser 2220 allows perfume supplied to the laundry.

The present invention is not limited to the embodiments described before.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The laundry device according to the present invention has the following advantageous effects.

First, according to the present invention, since the washing unit for washing and the drying unit for after-washing-treatment are integrated as one body, the treatment of the laundry may be done at one time.

Second, since steam is supplied to the drying chamber of the drying unit, the wrinkles of the laundry may be precluded more efficiently. Also, since steam is supplied to the laundry during the washing cycle, washing may be performed more efficiently.

Third, since the dry unit is integrated with the washing unit as one body, the structure of the laundry may be simplified as well as the production cost may be reduced. Also, since the dry unit and the washing unit as one body occupy relatively small space, the user may make the most use of space.

Fourth, since the laundry device according to the present invention allows its dry unit to supply steam and perfume to the laundry for a refreshing function such as sterilization and perfume diffuse, customer satisfaction measurement may be enhanced.

What is claimed is:

1. A multi-functional laundry device comprising:

a body forming an exterior of the laundry device;

a partition dividing the body into upper and lower parts;

a washing unit for washing the laundry provided in the body;

a drying unit integrated with the washing unit as one body for after-washing treatment including smoothing out wrinkles, and drying and keeping the laundry, the drying unit being provided in the body;

a single steam supplier for supplying steam to the laundry;

a steam flow path connecting the steam supplier to an interior of the drying unit;

a hot air supplier for supplying hot air to the laundry;

a hot air flow path connecting the hot air supplier to the interior of the drying unit, the hot air flow path being separate from the steam flow path;

a control unit provided at either of the washing unit and the drying unit for controlling the washing unit and the drying unit and controlling the steam supplier selectively to supply steam into the washing unit and drying unit according to selected courses;

a first duct extending from the drying unit to a fan;

a second duct extending from the fan and having a heater;

a first path connecting the second duct to the drying unit; and a second path connecting the second duct to the washing unit, the first path being the hot air flow path connecting the hot air supplier to the interior of the drying unit, wherein the washing unit and drying unit are divided by the partition.

2. The multi-functional laundry device of claim 1, wherein the steam supplier provided within the drying unit, the steam supplier comprises an inlet pipe for receiving water from outside, a water tank for storing the water drawn through the inlet pipe, a heater for heating the water and phase-changing the water into steam, and an outlet pipe for guiding the steam from the water tank to the laundry, the outlet pipe being a part of the steam flow path.

3. The multi-functional laundry device of claim 1, wherein the steam supplier is provided in either of the washing unit and the drying unit, and the steam generated in the steam supplier is supplied to at least one of a drum of the washing unit and a drying chamber of the drying unit.

4. The multi-functional laundry device of claim 3, wherein the steam supplier comprises an inlet pipe for receiving water from outside, a water tank for storing the water drawn through the inlet pipe, a heater for heating the water and phase-changing the water into steam, a first and a second outlet pipe for guiding the steam from the water tank to the laundry, the second outlet pipe being a part of the steam flow path, and a control valve for controlling the flow of the steam moving through the first and second outlet pipe.

5. The multi-functional laundry device of claim 1, wherein the hot air supplier supplies hot air into a drum of the washing unit and a drying chamber of the drying unit selectively.

6. The multi-functional laundry device of claim 5, wherein the hot air supplier comprises the fan for circulating air forcibly and the heater for heating the air flown by the fan.

7. The multi-functional laundry device of claim 1, wherein at least one hanger is provided within the drying chamber of the drying unit for keeping the laundry.

8. The multi-functional laundry device of claim 1, further comprising a perfume diffuser for diffusing perfume to the laundry.

9. A multi-functional laundry device comprising:

a body forming an exterior of the laundry device;

a partition dividing the body into upper and lower parts;

a washing unit for washing the laundry provided in the body;

a drying unit integrated with the washing unit as one body, the drying unit being provided in the body;

a single hot air supplier provided in either of the washing unit and the drying unit for supplying hot air to the laundry;

a hot air flow path connecting the hot air supplier to an interior of the drying unit;

a steam supplier provided in either of the washing unit and the drying unit for supplying steam to the laundry;

a steam flow path connecting the steam supplier to the interior of the drying unit, the steam flow path being provided separate from the hot air flow path;

a control unit provided at either of the washing unit and the drying unit for controlling the washing unit and the drying unit;

a first duct extending from the drying unit to a fan;

a second duct extending from the fan and having a heater;

a first path connecting the second duct to the drying unit; and a second path connecting the second duct to the washing unit, the first path being the hot air flow path connecting the hot air supplier to the interior of the drying unit, wherein the washing unit and drying unit are divided by the partition.

10. The multi-functional laundry device of claim 2, wherein the outlet pipe expands into the drying unit.

11. The multi-functional laundry device of claim 10, wherein the outlet pipe has a tube shape and comprises a plurality of outlet holes along the length direction.

12. The multi-functional laundry device of claim 11, wherein the outlet pipe is provided at a lower side of the drying unit and supplies steam in an upwards direction.

13. The multi-functional laundry device of claim 5, wherein the hot air supplier supplies hot air to overlap at least one course between the washing course and drying course or supplies hot air concurrently with supplying steam.

14. A multi-functional laundry device comprising:

a body forming an exterior of the laundry device;

a partition dividing the body into upper and lower parts;

a washing unit for washing the laundry provided in the body;

a drying unit integrated with the washing unit as one body, the drying unit being provided in the body;

a steam supplier for supplying steam to the laundry, the steam supplier being located in the drying unit;

a first path connecting the steam generator to an interior of the drying unit;

a hot air supplier for supplying hot air to the laundry, the hot air supplier being located in the drying unit;

a second path connecting the hot air supplier to the interior of the drying unit, the second path being separate from the first path;

a control unit provided at either of the washing unit and the drying unit for controlling the washing unit and the drying unit;

a first duct extending from the drying unit to a fan;

a second duct extending from the fan and having a heater;

the second path connecting the second duct to the drying unit; and a third path connecting the second duct to the washing unit, wherein the washing unit and drying unit are divided by the partition.

* * * * *